US008199061B2

(12) United States Patent
Tolleson, Jr. et al.

(10) Patent No.: US 8,199,061 B2
(45) Date of Patent: Jun. 12, 2012

(54) THERMAL COMPENSATING SUBREFLECTOR TRACKING ASSEMBLY AND METHOD OF USE

(75) Inventors: Joe Bennett Tolleson, Jr., Wylie, TX (US); Danieal Alan Beal, Allen, TX (US)

(73) Assignee: ASC Signal Corporation, Smithfield, NC (US)

( * ) Notice: Subject to any disclaimer, the term of this patent is extended or adjusted under 35 U.S.C. 154(b) by 450 days.

(21) Appl. No.: 12/550,956

(22) Filed: Aug. 31, 2009

(65) Prior Publication Data

US 2011/0050526 A1 Mar. 3, 2011

(51) Int. Cl.
*H01Q 3/00* (2006.01)

(52) U.S. Cl. ..... 343/757; 343/760; 343/765; 343/766

(58) Field of Classification Search ..... 343/757, 343/761, 765, 766, 781 CA, 878, 882, 760
See application file for complete search history.

(56) References Cited

U.S. PATENT DOCUMENTS 3,386,100 A * 5/1968 Jaszberenyi ..... 343/761
3,432,135 A 3/1969 Carr
3,611,393 A 10/1971 Kilber
5,579,018 A * 11/1996 Francis et al. ..... 343/757
6,166,700 A 12/2000 Jenkin et al.
2002/0101384 A1 8/2002 Brooker et al.

FOREIGN PATENT DOCUMENTS

| | | |
|---|---|---|
| EP | 0845833 | 6/1998 |
| GB | 1367331 | 9/1974 |
| JP | 08032346 | 2/1996 |

OTHER PUBLICATIONS

Search Report, related application GB1014189.3, issued Dec. 8, 2010 by Intellectual Patent Office, GB.

* cited by examiner

*Primary Examiner* — Hoang V Nguyen
(74) *Attorney, Agent, or Firm* — Babcock IP, PLLC

(57) ABSTRACT

A thermal compensating subreflector tracking assembly for a reflector antenna and methods of use. The subreflector tracking assembly provided with a base, an intermediate support and a subreflector mount. The intermediate support coupled to the base, movable normal to the base and the subreflector mount coupled to the intermediate support, movable orthogonal to the intermediate support. The movement in the Z, Y and or Z-axis enabling electrical performance optimizing reflector antenna beam alignment and/or focus adjustments resulting from asymmetric thermal distortion of the reflector antenna.

17 Claims, 6 Drawing Sheets

THERMAL COMPENSATING SUBREFLECTOR TRACKING ASSEMBLY AND METHOD OF USE

BACKGROUND

1. Field of the Invention

This invention relates to reflector antennas. More particularly, the invention relates to an improved subreflector beam steering arrangement operable to compensate for focus errors arising from thermal expansion and/or contraction of the reflector assembly and/or support apparatus.

2. Description of Related Art

Electrically large reflector antennas enable satellite to earth station RF communication links with extremely narrow beamwidths. Typically, the earth station reflector antenna is aligned with the orbital path of the target satellite via a tracking mount that orients the entire antenna assembly to align the reflector antenna with the satellite. Due to the significant weight and windloading inherent in a large reflector antenna, tracking mounts with precision alignment capability, for example ±0.05 degrees or less, significantly increase the cost and complexity of the resulting earth station.

Commonly owned U.S. Pat. No. 6,943,750, "Self-Pointing Antenna Scanning" by Brooker et al, issued Sep. 13, 2005, hereby incorporated by reference in its entirety, discloses an antenna alignment assembly for a reflector antenna utilizing orthogonal adjustments made to the position of the subreflector with respect to the main reflector. This subreflector tracking technology is particularly useful, for example, for small beam alignment adjustments between the reflector antenna and a satellite in geosynchronous orbit as the satellite wobbles and/or drifts within its orbit. Handling these small alignment adjustments via subreflector tracking technology significantly simplifies the requirements of an additional tracking mount, if any.

Competition in the reflector antenna market has focused attention on improving electrical performance and minimization of overall manufacturing, inventory, distribution, installation and maintenance costs. Therefore, it is an object of the invention to provide a reflector antenna and/or sub-system(s) that overcome deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has analyzed reflector antenna electrical performance to quantify specific reflector antenna electrical performance degradation factors such as wind driven deflections and thermal deformation. Analysis of temperature differentials introduced via solar load and/or de-ice equipment demonstrates that thermal deformation is typically not uniform and is time dependent. When solar load is applied at varying angles throughout the day, a point of maximum heating changes as portions of the reflector surface and/or supports are fully exposed to sunlight and/or are shaded by other portions of the reflector antenna. The inventor has determined that non-uniform thermal distortions significant enough to impact electrical performance of the reflector antenna may occur due to asymmetric solar load peaks during the late morning and again at a shifted location in the late afternoon as angle of the sun shifts with respect to the reflector.

Figure 1:
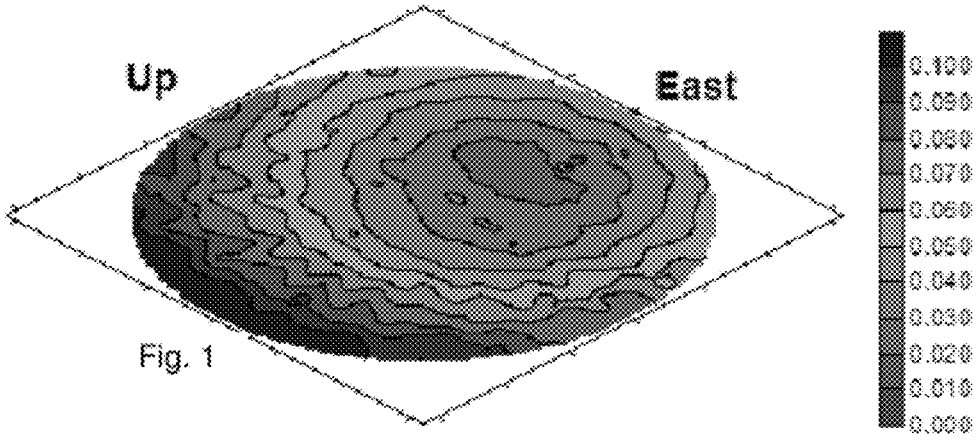
FIG. 1 is a chart demonstrating non-uniform heating of a reflector antenna main reflector under solar load.
Figure 2:
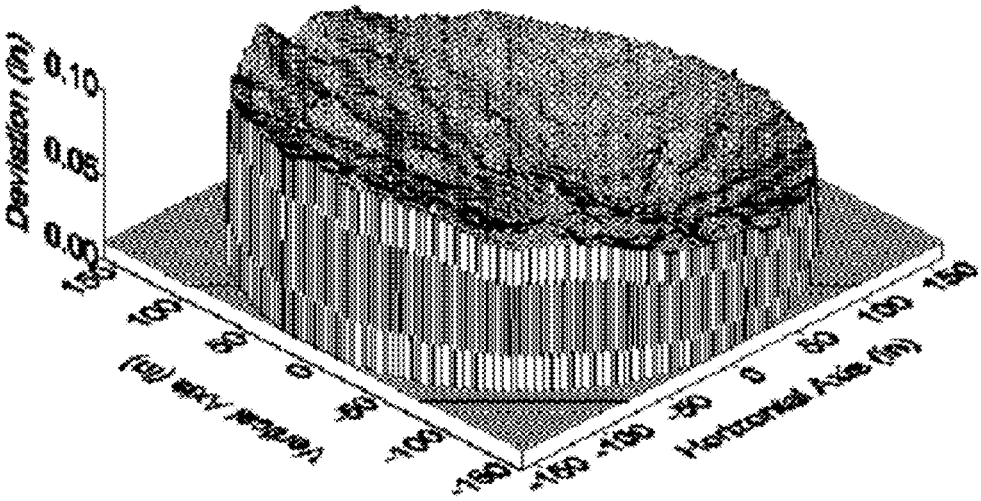
FIG. 2 is a chart demonstrating corresponding main reflector curvature deformation corresponding to the solar load of FIG. 1.
Figure 3:
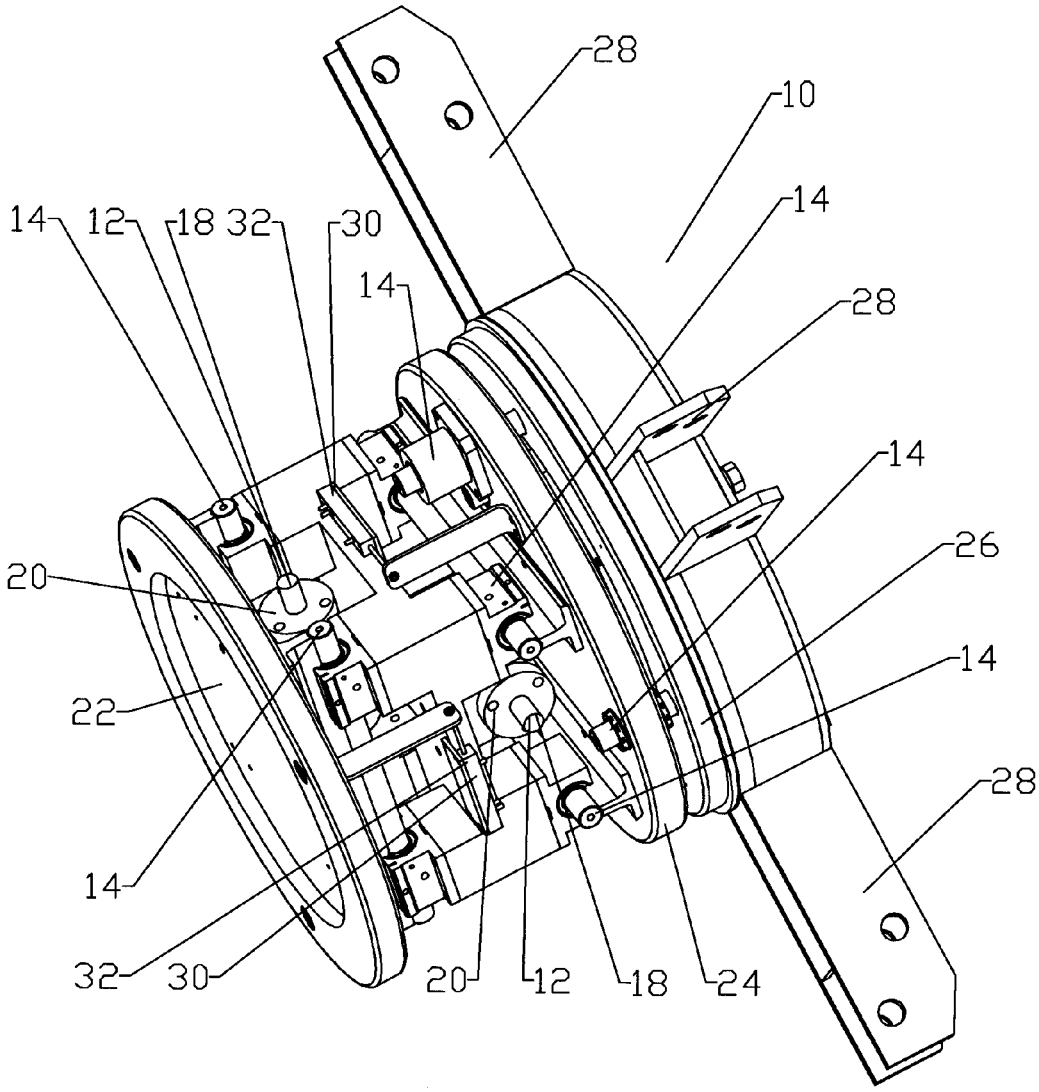
FIG. 3 is an isometric view of an exemplary embodiment of a subreflector tracking assembly.
Figure 4:
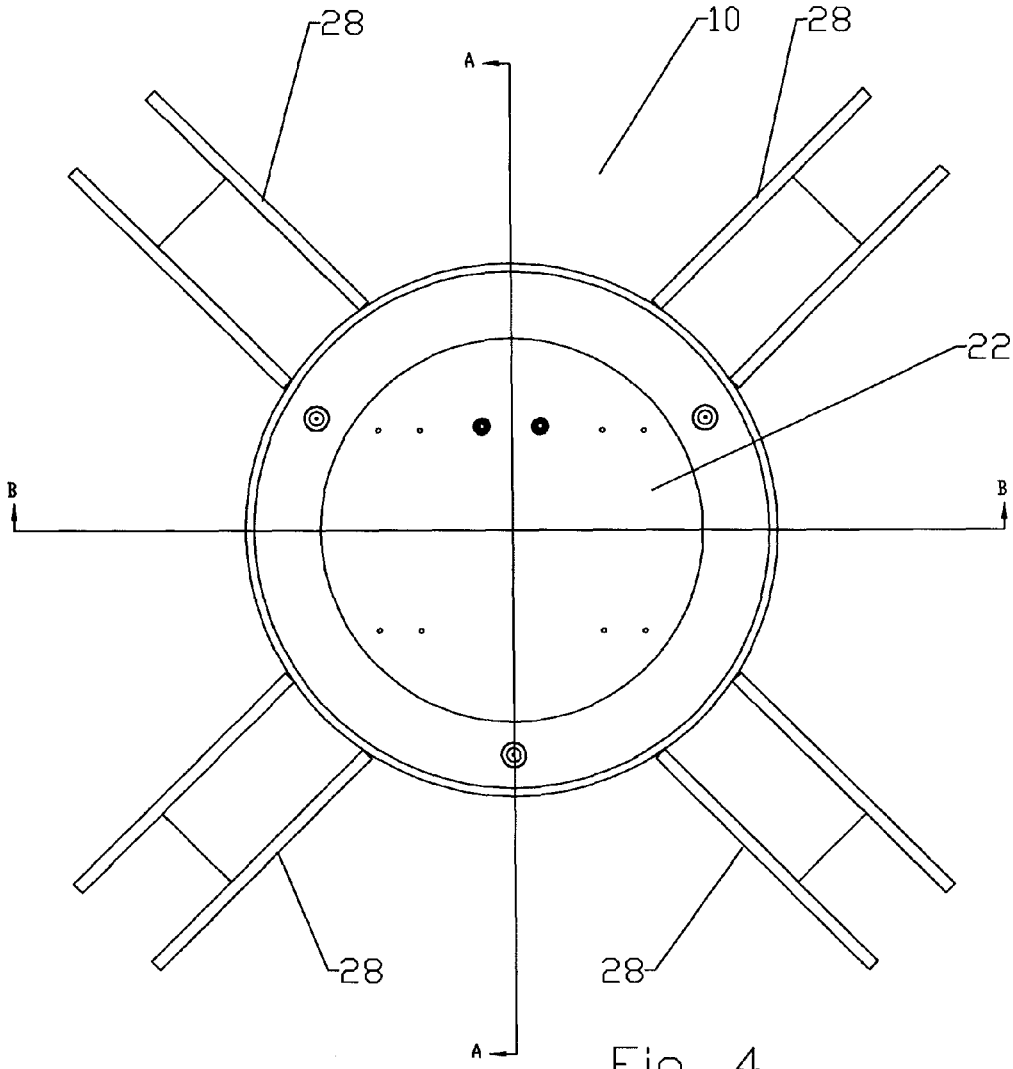
FIG. 4 is an end view of a subreflector mount end of the assembly of FIG. 3.
Figure 5:
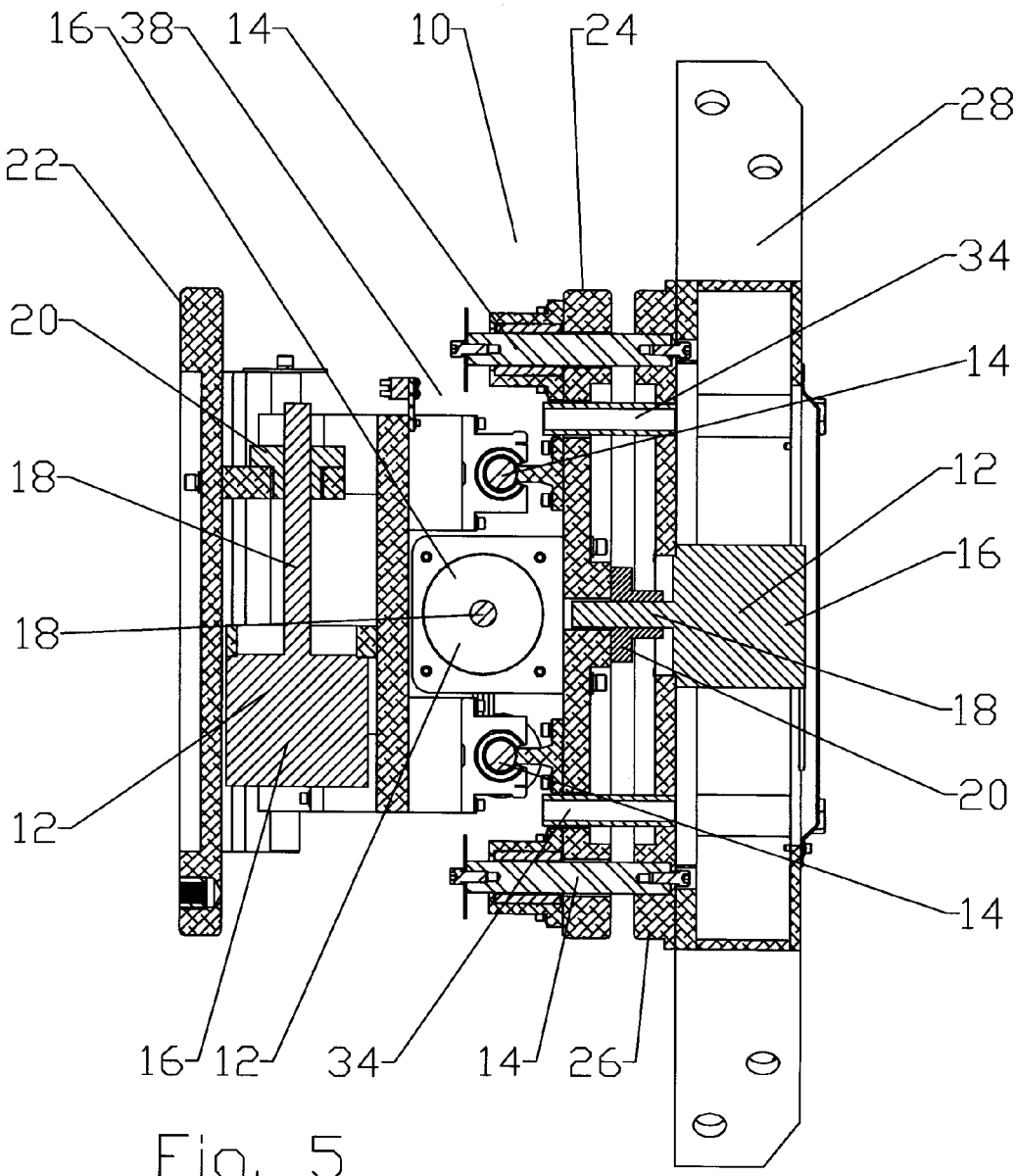
FIG. 5 is a cut-away side view along line A-A of FIG. 4.
Figure 6:
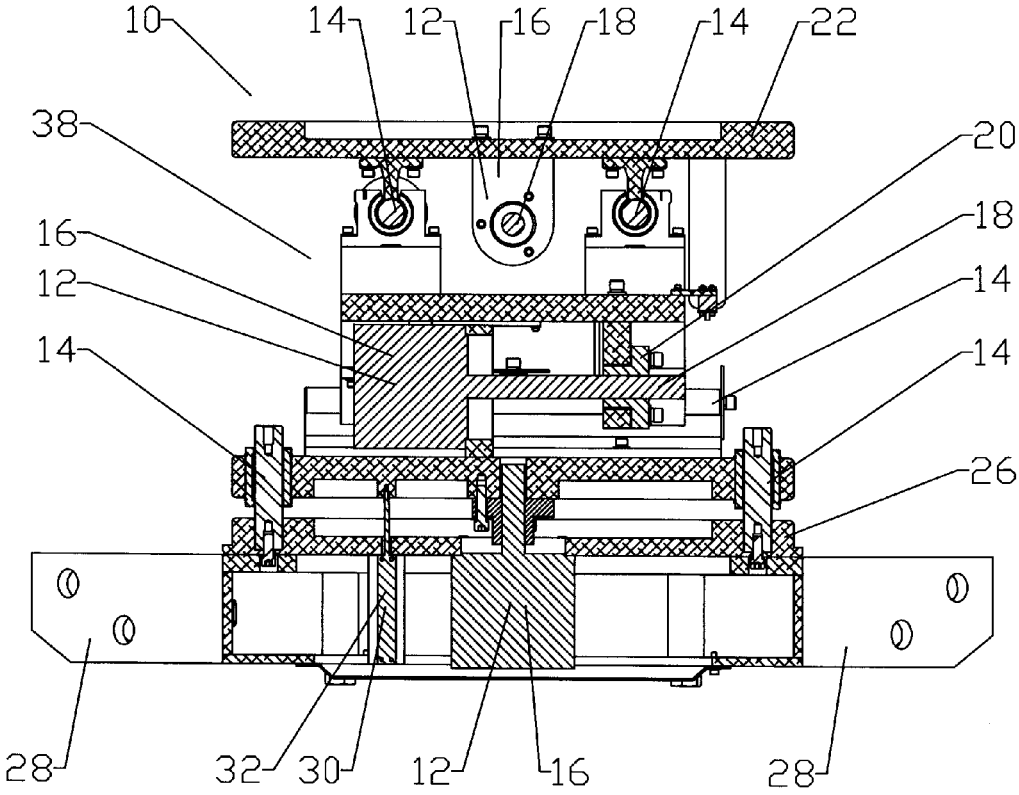
FIG. 6 is a cut-away side view along line B-B of FIG. 4.
Figure 7:
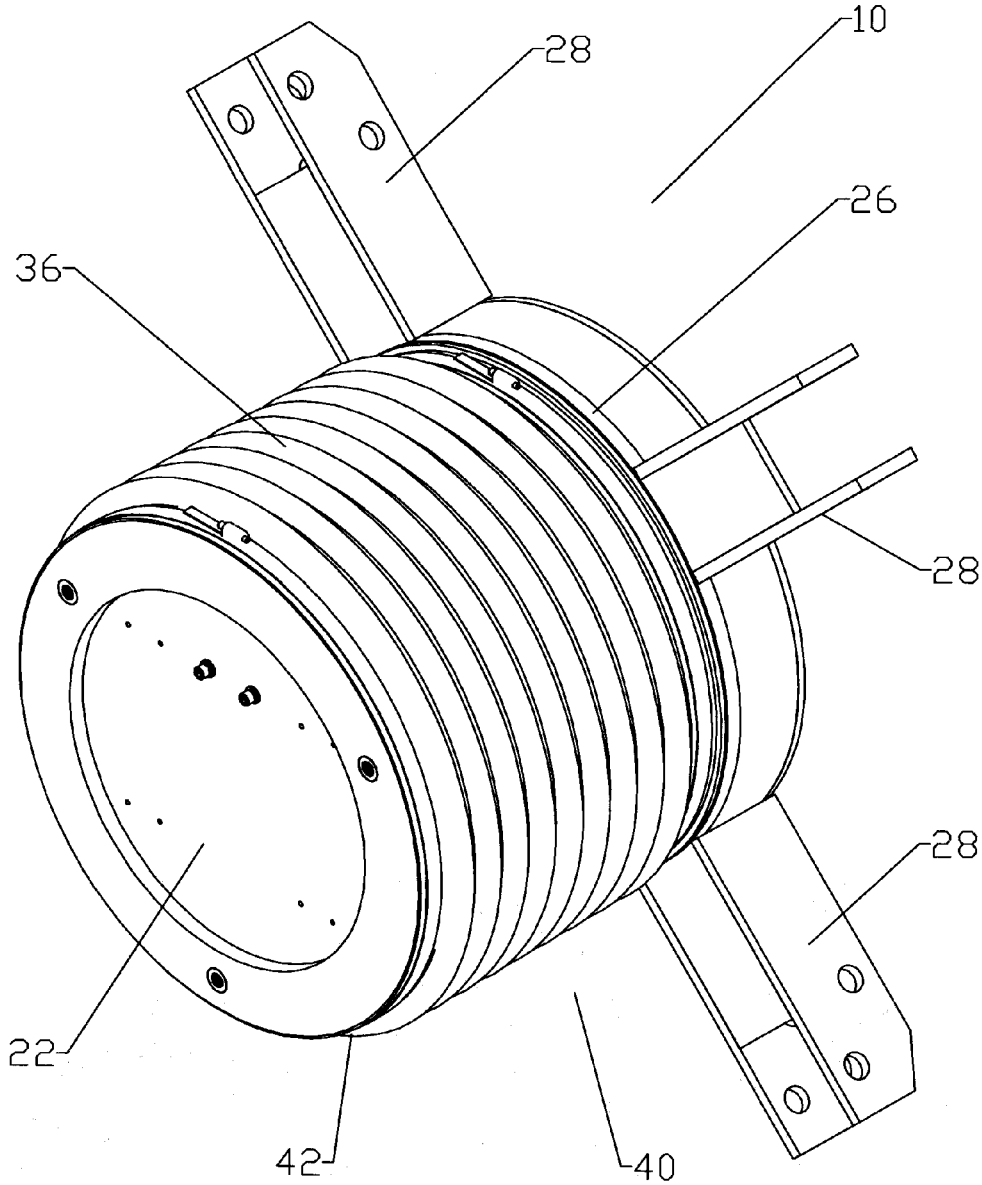
FIG. 7 is an isometric view of the assembly of FIG. 3, with a bellows coupled to the subreflector mount and the base.

As shown in FIG. 1, a reflector antenna orientation for typical geosynchronous orbits in the northern hemisphere generates a peak localized distortion that is off center with respect to the z-axis of the reflector antenna, resulting in non-uniform deformation of the reflector that changes the phase center of the reflector and thereby the overall boresight of the reflector antenna. Although the X-Y adjustment capabilities disclosed in U.S. Pat. No. 6,943,750 may partially compensate for an off center beam shift due to thermal distortion, a defocusing effect resulting from the localized deepening of the reflector at the peak localized distortion also occurs, as shown in FIG. 2. The inventor's computer models demonstrate that for an 8.1 meter Ka Band reflector antenna, this defocusing effect generates signal gain losses of approximately 0.6 dB (receive) and 1.4 dB (transmit).

A carriage based subreflector tracking assembly as generally described in U.S. Pat. No. 6,943,750 that further includes z-axis movement of the subreflector with respect to the reflector enables compensation for the defocusing effect identified by the inventor. An exemplary embodiment of a subreflector tracking assembly 10, as shown in FIGS. 3-7, demonstrates z-axis movement capability, generally parallel to the boresight of the reflector antenna. The Z-axis mechanism may be added with minimal additional complexity and/or overall increase in the subreflector tracking assembly 10 dimensions. To minimize any slop, drive windup, axis wobble or backlash, the subreflector tracking assembly 10 utilizes at least one linear actuator 12 for each of the X, Y and Z-axis. Depending upon the type of linear actuator 12 selected, one or more guide(s) 14 may also be applied parallel to each linear actuator 12 to reduce mechanical loads on the linear actuator 12 and improve axial precision. The linear actuator(s) 12 may be, for example, stepper motor(s) 16 with a lead screw 18 that drives a threaded nut 20 axially along the lead screw 18. The guide(s) 14 may be, for example, self aligning, re-circulating, ball bushing or plain linear bearings and/or rails.

In the present embodiment, X and Y-axis linear actuator(s) 12 and guide(s) 14 are mounted between a subreflector mount 22 and an intermediate support 24 arranged to provide orthogonal movement of the subreflector mount 22 with respect to the intermediate support 24. The Z-axis linear actuator 12 may be positioned between the intermediate support 24 and a base 26. The base 26 may be provided with mounting point(s) 28 for interconnection with mounting struts supporting the subreflector tracking assembly 10. The subreflector may be attached to the subreflector mount 22, positioned proximate the expected focal point of the associated main reflector. Because the Z-axis linear actuator 12 is primarily compensating for thermal defocusing, the range of the Z-axis linear actuator 12 may be significantly less than the X and Y-axis linear actuator(s) 12. For example, an 8.1 m reflector antenna may utilize a Z-axis linear actuator 12 with a travel range of 0.5 inches or less.

One skilled in the art will appreciate that the base 26, intermediate support 24 and subreflector mount 22 element labels have been applied for ease of explanation. The arrangement of the Z-axis linear actuator 12 and the X and Y-axis linear actuator(s) 12 on either side of the intermediate support 24 is not dependent upon which end of the subreflector tracking assembly 10 the subreflector is mounted to, and similarly which end is coupled to the mounting struts. For example, in a reversed alternative configuration, the subreflector mount 22 may be coupled to struts of the reflector antenna and the subreflector coupled to the base 26.

Spatial calculations for driving the various linear actuator (s) 12 along each axis may be simplified by arranging each of the base 26, intermediate support 24 and subreflector mount 22 parallel to one another. A feedback sensor 30 along each axis may be utilized to monitor the position of each linear actuator 12 along its range of movement. The feedback sensor 30 may be applied, for example, as a linear potentiometer 32, resolver, encoder or limit switch(s).

Control, power and/or feedback wiring may be routed through one or more sleeve(s) 34 extending through the intermediate support 24 to minimize the chance of wiring damage over time due to movement between the base 26 and intermediate support 24 driven by the Z-axis linear actuator 12. A bellows 36 coupled to a periphery of the base 26 and the subreflector mount 22 may be applied to isolate and environmentally protect an interior 38 of the subreflector tracking assembly 10 from the exterior 40. To minimize the chance of condensate buildup or the like within the assembly over time, the bellows 36 and/or the subreflector mount may be provided with one or more drain hole(s) 42.

In use, a three point peaking algorithm may be applied that monitors the signal level seen by a receiver, the signal gain, to determine the beam peak. As the linear actuator(s) 12 move the subreflector mount 22 and thereby the subreflector, changes in signal gain are monitored and further scanning movement of the subreflector tracking assembly 10 constantly driven with respect to the X, Y and Z co-ordinate location of the subreflector at the last recorded beam peak. Because the beam peak occurs when both alignment and focus is optimal, the peaking algorithm need not differentiate between scanning for optimal beam alignment or focus.

A periodic interval may be applied between scans for a further beam peak. Similarly, scans within the Z-axis may be further initiated responsive to a preset time, signal gain change, time interval and/or a temperature change, for example sensed by a temperature sensor local to the reflector antenna.

Should the peaking algorithm direct the assembly out of range in the X or Y axis, a signal and/or alarm may be generated to initiate an adjustment of a tracking mount of the antenna, to re-center the assembly.

One skilled in the art will appreciate that a subreflector tracking assembly 10 as disclosed provides a significant improvement in electrical performance at minimal additional cost and/or system complexity.

Table of Parts

| | |
|---|---|
| 10 | subreflector tracking assembly |
| 12 | linear actuator |
| 14 | guide |
| 16 | stepper motor |
| 18 | lead screw |
| 20 | threaded nut |
| 22 | subreflector mount |
| 24 | intermediate support |
| 26 | base |
| 28 | mounting point |
| 30 | feedback sensor |
| 32 | linear potentiometer |
| 34 | sleeve |
| 36 | bellows |
| 38 | interior |
| 40 | exterior |
| 42 | drain hole |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A thermal compensating subreflector tracking assembly, comprising:

a base;

an intermediate support;

a subreflector mount;

a bellows coupled to the base and the subreflector mount; and a drain hole between an exterior and an interior enclosed by the bellows;

the intermediate support coupled to the base, movable normal to the base;

the subreflector mount coupled to the intermediate support, movable orthogonal to the intermediate support.

2. The subreflector tracking of claim 1, wherein a linear actuator moves the intermediate support normal to the base.

3. The subreflector tracking assembly of claim 2, wherein the linear actuator is a stepper motor coupled to the base; a lead screw of the stepper motor driving a threaded nut coupled to the intermediate support.

4. The subreflector tracking assembly of claim 2, wherein at least one linear bearing aligns the movement of the intermediate support normal to the base.

5. The subreflector tracking assembly of claim 1, further including a feedback sensor configured to sense the position of the intermediate support with respect to the base.

6. The subreflector tracking assembly of claim 5, wherein the feedback sensor is a potentiometer.

7. The subreflector tracking assembly of claim 1, wherein the intermediate support and subreflector mount are parallel to the base.

8. The subreflector tracking assembly of claim 1, further including at least one wire sleeve extending from the base to between the intermediate support and the subreflector mount.

9. A thermal compensating subreflector tracking assembly, comprising:

a base;

an intermediate support;

a subreflector mount;

the intermediate support and subreflector mount aligned generally parallel to the base the intermediate support coupled to the base, movable normal to the base via a linear actuator;

a feedback sensor configured to sense the position of the intermediate support with respect to the base;

the subreflector mount coupled to the intermediate support, movable orthogonal to the intermediate support;

the intermediate support and subreflector parallel to the base throughout a range of motion;

a bellows coupled to the base and the subreflector mount; and at least one wire sleeve extending from the base to between the intermediate support and the subreflector mount.

10. A method for reflector antenna thermal defocusing compensation, comprising the steps of:

adjusting a subreflector mount of a subreflector tracking assembly supported proximate a focal point of a reflector antenna along an X, Y and Z-axis of the reflector antenna until a signal gain of the reflector antenna is maximized; and adjusting the subreflector mount via a tracking mount of the reflector antenna if a feedback sensor indicates that an X or Y-axis travel limit of the subreflector mount has been reached.

11. The method of claim 10, wherein the adjusting of the subreflector mount is repeated at a periodic interval.

12. The method of claim 10, wherein the adjusting of the subreflector mount is initiated responsive to a change in temperature.

13. The method of claim 10, wherein the adjusting of the subreflector mount is initiated responsive to a preset time.

14. The method of claim 10, wherein a range of adjustment along the z-axis is less than 0.5 inches.

15. The method of claim 10, wherein the adjustment is enabled by a change in the signal gain.

16. The method of claim 10, further including the step of adjusting the subreflector mount with respect to a recorded position of the highest signal gain within a defined period: and resetting the recorded position if the adjusting of the subreflector mount results in a higher signal gain.

17. The method of claim 10, wherein the adjustment to the subreflector mount is performed via actuation of a linear actuator for each of the X, Y and Z-axis.

* * * * *